United States Patent [19]

Horikawa

[11] Patent Number: 4,982,419

[45] Date of Patent: Jan. 1, 1991

[54] POTTER-BUCKY DEVICE

[75] Inventor: Kazuo Horikawa, Kanagawa, Japan

[73] Assignee: Fuji Photo Film Co., Ltd., Kanagawa, Japan

[21] Appl. No.: 296,728

[22] Filed: Jan. 13, 1989

[30] Foreign Application Priority Data

Mar. 19, 1988 [JP] Japan ..... 63-66745

[51] Int. Cl.[5] ..... G21K 1/00

[52] U.S. Cl. ..... 378/155

[58] Field of Search ..... 378/155, 154

[56] References Cited

U.S. PATENT DOCUMENTS 2,138,555 11/1938 Ötvös ..... 378/155
4,258,264 3/1981 Kotera et al. .
4,590,517 5/1986 Kato et al. .
4,710,875 12/1987 Nakajima et al. .

FOREIGN PATENT DOCUMENTS 0114978 8/1984 European Pat. Off. .
56-11395 2/1981 Japan .
58-163339 9/1983 Japan .

*Primary Examiner*—Craig E. Church
*Attorney, Agent, or Firm*—Sughrue, Mion, Zinn, Macpeak & Seas

[57] ABSTRACT

A Potter-Bucky device for a radiation image recording apparatus in which an image recording medium is exposed to radiation which has passed through an object in order to record a radiation image of the object on the recording medium includes a grid which is supported by a support member between the object and the recording medium and is reciprocated parallel to the recording medium. A balancer is also connected to the support member and is reciprocated in synchronization with said grid but in the opposite direction.

12 Claims, 7 Drawing Sheets

POTTER-BUCKY DEVICE

BACKGROUND OF THE INVENTION

1. Field of the Invention

This invention relates to a Potter-Bucky device for use in a radiation image recording apparatus, and more particularly to a Potter-Bucky device which cannot transmit adverse vibrations to other parts of an apparatus in which it is employed.

2. Description of the Prior Art

There has been in wide use a radiation image recording apparatus in which a radiation image of an object is recorded on an X-ray film by exposing the X-ray film to radiation such as X-rays which have passed through the object.

Further, there has been known a radiation image recording and reproducing system in which a radiation image is recorded and reproduced by the use of a stimulable phosphor instead of the X-ray film. When certain kinds of phosphors are exposed to radiation such as X-rays, $\alpha$-rays, $\beta$-rays, $\gamma$-rays, cathode rays or ultraviolet rays, they store part of the energy of the radiation. Then when the phosphor which has been exposed to radiation is exposed to a stimulating ray, such as a laser beam, light is emitted from the phosphor in proportion to the amount of radiation energy which was stored by the phosphor. A phosphor exhibiting such properties is referred to as a stimulable phosphor. In a radiation image recording and reproducing system, a radiation image of an object such as the human body is recorded and reproduced by the use of such a stimulable phosphor. Specifically, as disclosed, for instance, in U.S. Pat. No. 4,258,264 and Japanese Unexamined Patent Publication No. 56(1981)-11395, a recording medium bearing thereon a stimulable phosphor layer is first exposed to radiation which has passed through an object in order to store a radiation image of the object in the stimulable phosphor layer, and then the stimulable phosphor layer is two-dimensionally scanned with a stimulating ray which causes it to emit light in a pattern corresponding to the stored radiation image. The light emitted from the stimulable phosphor layer upon stimulation thereof is photoelectrically detected and converted into an electric image signal, which is processed to reproduce the radiation image as a visible image on a recording medium such as a photosensitive material, a display system such as a CRT, or the like.

This system is advantageous over conventional radiography which uses X-ray film in that a radiation image can be recorded over a much wider radiation energy exposure range. That is, it has been found that the intensity of light emitted from the stimulable phosphor upon stimulation thereof after it is exposed to radiation remains proportional to the energy of the radiation to which it was exposed for a very wide radiation energy intensity range. Accordingly, even if the energy intensity range of the radiation to which the stimulable phosphor is exposed varies substantially due to changes in the recording conditions, a visible radiation image independent of variations in the radiation energy intensity range can be obtained by choosing an appropriate gain when converting the light emitted from the phosphor into an electric signal.

In radiation image recording systems in which X-ray film or a stimulable phosphor layer (both generically referred to as an image recording medium) is exposed to radiation which has passed through an object so as to record a radiation image of the object, a grid is sometimes disposed between the object and the image recording medium. That is, when a relatively thick part of an object, such as the chest of a human body, is radiographed, diffused radiation emitted from the object upon radiographing can deteriorate the quality of the radiation image obtained. In such cases, a grid device for absorbing the diffused radiation should be provided between the object and the recording medium. As is well known, a grid device comprises lead foils or the like arranged in parallel or in a grid and is disposed so as to overlap with the whole image recording area of the image recording medium.

When such a grid device is kept stationary during the recording of a radiation image, fine stripes corresponding to the foils of the grid are projected onto the recording medium together with the radiation image of the object. Since the stripes are very fine, the stripes are almost invisible when the radiation image is recorded on X-ray film. However, when the stimulable phosphor layer is used to record the radiation image, the stripes are visible as moire fringes since the stimulable phosphor is more sensitive than the X-ray film and the radiation image stored in the stimulable phosphor layer is read out by scanning the stimulable phosphor layer with a light beam at very fine pitches. Particularly, in radiation image recording systems in which a stimulable phosphor layer is utilized and subtraction processing of image signals is involved, such as the systems disclosed in U.S. Pat. Nos. 4,710,875, 4,590,517 and Japanese Unexamined Patent Publication No. 58(1983)-163339, and the like, the stimulable phosphor layers storing therein different radiation images such as ones recorded before and after the infusion of a contrast medium, or digital image signal tapes bearing thereon image signals read out from the stimulable phosphor layers are subjected to translation processing and/or rotation processing in order to correct fluctuation in the position of the radiation images recorded on the stimulable phosphor layers. The fine stripes recorded on the stimulable phosphor layers interfere with each other during translation and rotation processing in such a way that they produce moire fringes in the finally reproduced image, thereby very adversely affecting diagnoses based on the reproduced image.

As disclosed in EP-0114978, there has been proposed a Potter-Bucky device having a driving means for driving the grid back and forth at a high speed in parallel to the stimulable phosphor layer. This arrangement prevents part of the recording medium from being shielded by the foils of the grid during image recording, thereby preventing the formation of stripes on the recording medium and the production of moire fringes in the radiation image which has been read out, even if the recording medium uses a stimulable phosphor layer.

However there is a problem in that, though the Potter-Bucky device can prevent production of the moire fringes, it is apt to transmit vibrations to other parts of the system due to the movement of the grid. Particularly, in the case of a so-called built-in type radiation image recording and reproducing system, in which an image recording device, an image read-out device and an erasing device are incorporated into a single unit and the recording medium having the stimulable phosphor layer is conveyed or circulated through the system, when vibrations are transmitted from the Potter-Bucky device in the image recording device to the image readout device, if the image read-out device is carrying out the image read-out operation, the accuracy of the read-out operation deteriorates.

SUMMARY OF THE INVENTION

In view of the foregoing observations and description, the primary object of the present invention is to provide a Potter-Bucky device in which no vibration is transmitted to parts of an apparatus around the device even if the grid is moved.

The Potter-Bucky device in accordance with the present invention comprises a grid which is disposed in a radiation image recording apparatus for exposing an image recording medium to radiation which has passed through an object in order to store a radiation image of the object on the recording medium and is supported by a support means between the object and the recording medium, and a grid driving means which reciprocates the grid parallel to the recording medium, and is characterized by having a balancer, which is connected to the support means and is reciprocated in synchronization with said grid but in the opposite direction, thereby compensating for displacement of the center of gravity of the Potter-Bucky device due to the reciprocation of the grid.

With this arrangement, the vibration caused by the displacement of the center of gravity of the Potter-Bucky device due to the movement of the grid is compensated for by the movement of the balancer, and accordingly, no vibration is transmitted to parts of the apparatus around the Potter-Bucky device.

DESCRIPTION OF THE PREFERRED EMBODIMENTS

Figure 1:
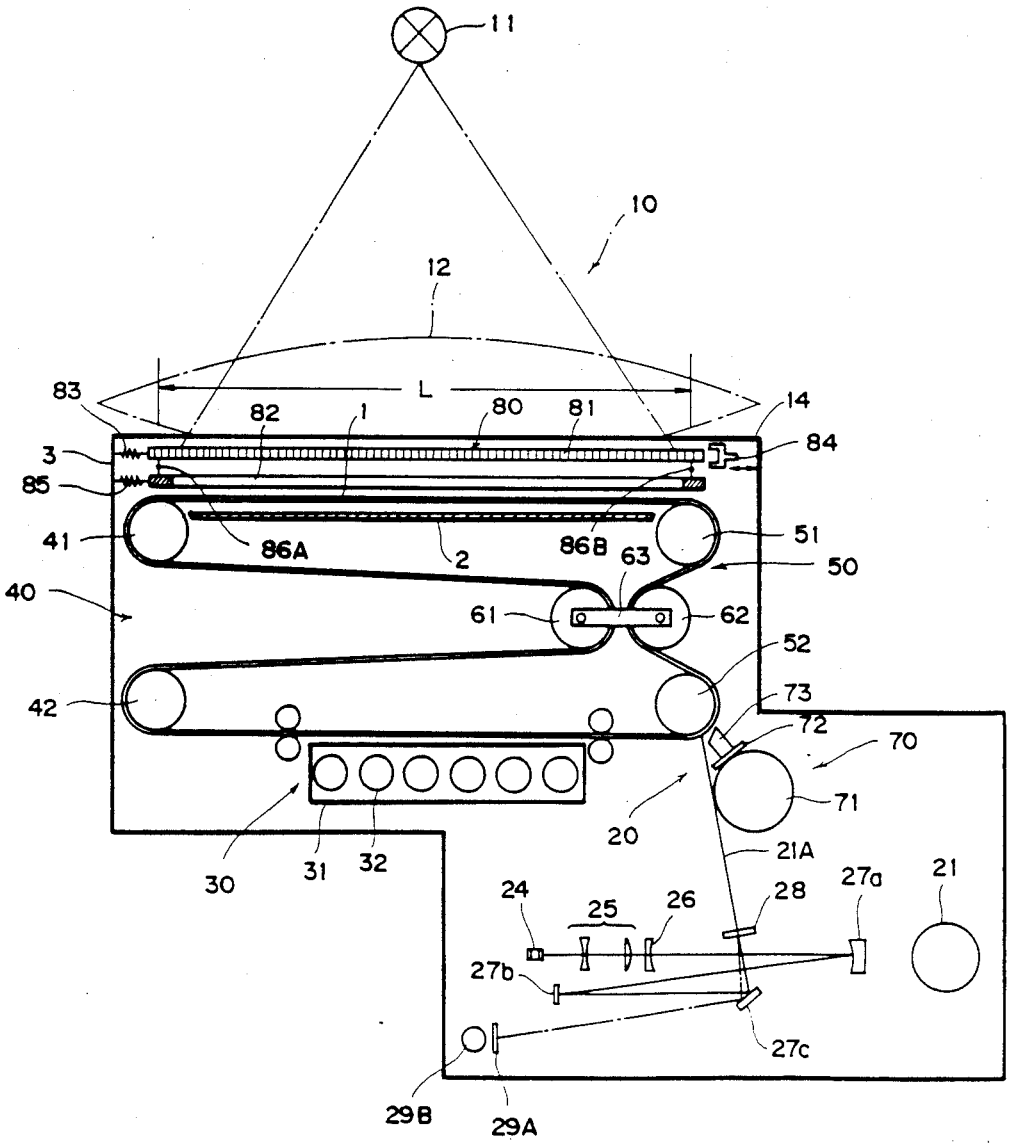
FIG. 1 is a schematic side view showing a radiation image recording and read-out apparatus provided with a Potter-Bucky device in accordance with an embodiment of the present invention.

In FIG. 1, a radiation image recording and readout apparatus has a recording belt 1 as the recording medium. The recording belt is in the form of an endless belt which has a stimulable phosphor layer formed on the entire area thereof. The recording belt 1 is passed around a recording belt conveying roller system and is circulated in the apparatus. The conveying roller system comprises first and second roller sections 40 and 50 spaced from each other by a distance L (the distance L being taken from the center of one section to the center of the other section), and a pair of idle rollers 61 and 62. The first roller section 40 includes an upper roller 41 and a lower roller 42. The second roller section 50 includes an upper roller 51 and a lower roller 52. The idle rollers 61 and 62 are connected by a connecting member 63 and are moved left and right integrally with each other by a driving means (not shown). The recording belt 1 is passed around the idle roller 61 between the upper and lower rollers 41 and 42 of the first roller section 40 along the face opposed to the idle roller 62. Similarly, the recording belt 1 is passed around the idle roller 62 between the upper and lower rollers 51 and 52 of the second roller section 50 along the face opposed to the idle roller 61.

A radiation source 11 (e.g., an X-ray source) is disposed so as to oppose the recording belt 1 from above. The upper part of the apparatus shown in FIG. 1 including the radiation source 11 and a recording table 14 on which an object is placed forms a radiation image recording section 10.

When the radiation source 11 is operated with an object placed on the recording table 14, the recording belt 1 is exposed to radiation which has passed through an object 12 and a radiation image of the object 12 is stored in the stimulable phosphor layer on the recording belt 1. The center-to-center distance L between the roller sections 40 and 50 is substantially equal to the length of the largest radiation image frame which can be recorded by this particular apparatus. Accordingly, one radiation image is recorded on a part or the whole of the upper run of the recording belt 1 .

Figure 2:
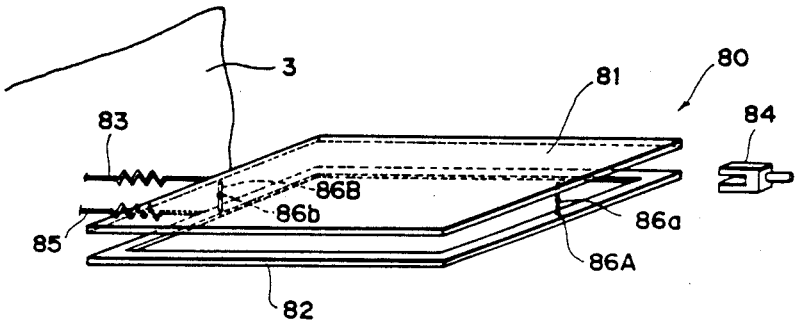
FIG. 2 is a perspective view showing the Potter-Bucky device, FIGS. 3(*a*) and 3(*b*) are schematic side views showing different states of the Potter-Bucky device.

A Potter-Bucky device 80 in accordance with an embodiment of the present invention is disposed between the recording table 14 and the recording belt 1 in the image recording section 10. As shown in FIGS. 1 and 2, the Potter-Bucky device 80 comprises a grid 81 having lead foils, a grid driving means which includes a spring 83 and a gripping means 84 movable left and right as seen in FIG. 1 and reciprocates the grid 81, and a balancer 82. The grid 81 is of such a size that it covers all of that part of the recording belt 1 which is positioned in the radiation image recording section 10. One end of the grid 81 is connected to one end of spring 83, the other end of spring 83 being connected to a side wall 3 of the apparatus. When recording a radiation image of an object, the gripping means 84 grips the other end of grid 81 and pulls the grid 81 rightward prior to irradiation, overcoming the force of the spring 83. Then the gripping means 84 releases the grid 81, whereby the grid 81 is repeatedly reciprocated in the horizontal direction. Such a movable grid 81 permits almost all the radiation which has passed through the object 12 to impinge upon the recording belt 1 below the grid 81, while removing almost all the radiation diffused from the object 12. Further since the grid 81 is moved in the manner described above, no stripes are formed on the recording belt 1 and accordingly moire fringes cannot be produced in the final visible image.

In the apparatus shown in FIG. 1, radiation image recording in the image recording section 10 and radiation image read out in a radiation image read-out section 20 (located at the lower right of the apparatus) are occasionally carried out simultaneously as will be described in detail later. In such cases, if vibrations generated by the reciprocation of the grid 81 are transmitted to the radiation image read-out section 20, the read out cannot be performed accurately. In the Potter-Bucky device 80 of this embodiment, the balancer 82 prevents vibrations from being transmitted to parts of the apparatus around the Potter-Bucky device 80.

The balancer 82 is connected to one end of a spring 85, the other end of which is connected to the side wall 3 of the apparatus, and is connected to the grid 81 at both ends by way of a pair of connecting members 86A and 86B. Further, as is clearly shown in FIG. 2, the balancer 82 comprises only an outer frame which does not block radiation. The connecting members 86A and 86B are rotatable about respective supports **86*a* and 86*b* located at their middles. With this arrangement, the balancer 82 is moved in the direction opposite to the grid 81 but in synchronization with the movement of the grid 81**.

Figure 3A:
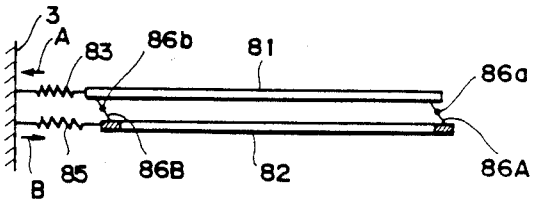
Figure 3B:
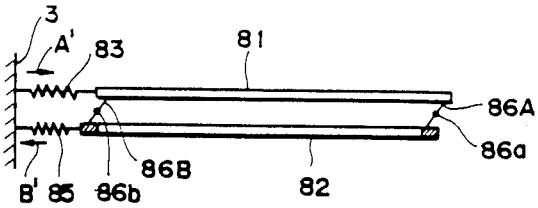

That is, as shown in FIG. 3(*a*) when spring 83 is compressed during the reciprocation of the grid 81, the center of gravity of the grid 81 is displaced leftward. At this time, the balancer 82 is moved to a position in which the spring 85 is stretched and the center of gravity of the balancer 82 is displaced rightward. Accordingly, the displacement of the center of gravity in the direction of arrow A is compensated for by the displacement of the center of gravity in the direction of arrow B, and therefore the center of gravity of the whole Potter-Bucky device 80 is not displaced. On the other hand, when the center of gravity of the grid 81 is displaced in the direction of arrow A′ and the spring 83 is stretched as shown in FIG. 3(*b*), the center of gravity of the balancer 82 is displaced in the direction of arrow B′ and the spring 85 is compressed. Accordingly, the center of gravity of the whole Potter-Bucky device is also not displaced in this case. Thus, in the Potter-Bucky device of this embodiment, the grid 81 can be reciprocated without vibrating either the whole apparatus or the parts of the apparatus around the Potter-Bucky device 80. In order to balance the displacement of the center of gravity of the grid 81 with the displacement of the center of gravity of the 10 balancer 82, the formula, $W_1 \times l_1 = W_2 \times l_2$, should be satisfied, wherein $W_1$, $W_2$, $l_1$ and $l_2$ respectively represent the mass of the grid 81, the mass of the balancer 82, the length between the grid 81 and the support (**86*a* or 86*b*) of the connecting member (86A or 86B), and the length between the balancer 82 and the support of the connecting member. Only one side of each of the grid 81 and the balancer 82 may be connected to the side wall 3** by way of a spring.

Figure 4:
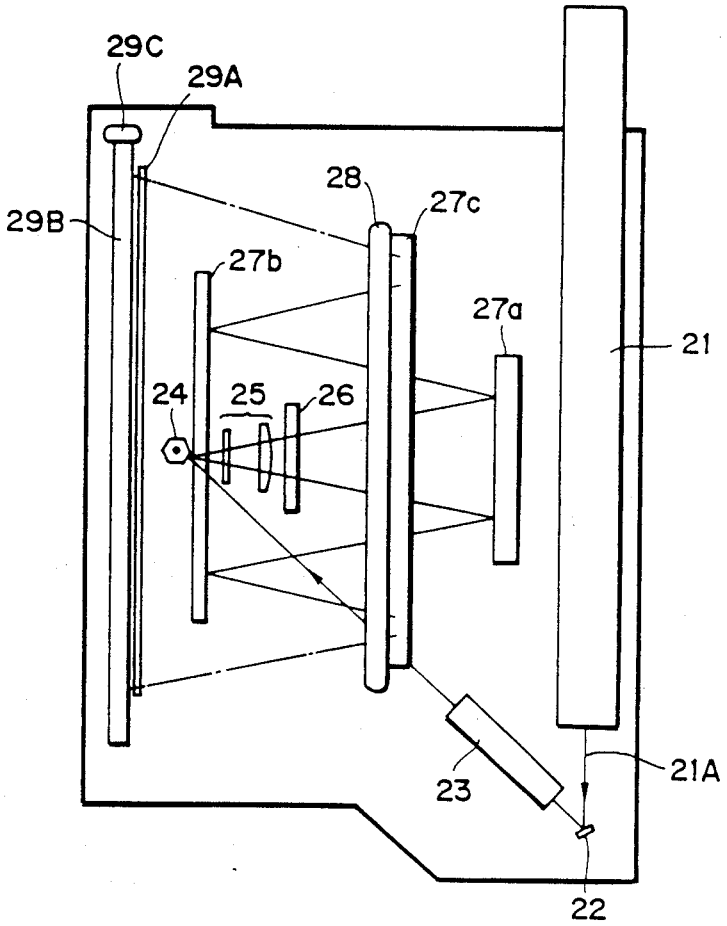
FIG. 4 is a plan view showing the radiation image read-out section of the radiation image recording and read-out apparatus, FIGS. 5(*a*) to 5(*g*) and FIGS. 6(*a*) to 6(*h*) are schematic views for illustrating the relation between the position of the idle rollers and the operation of each section in the apparatus.

The recording area of the recording belt (the part of the recording belt 1 on which the radiation image of the object 12 is to be recorded) is held still in the image recording section 10 where it faces the radiation source 11 while recording of the radiation image is carried out, and when the recording is finished, the recording area is conveyed to the image read-out section 20 below the lower roller 52 by means of the recording belt conveying roller system. The image read-out section 20 will be described in detail hereinbelow with reference to FIG. 4 together with FIG. 1.

The image read-out section 20 includes a stimulating ray source 21 which extends perpendicular to the recording belt conveying direction and emits a stimulating ray 21A. The stimulating ray source 21 may comprise an He-Ne laser, for example. A rotary polygonal mirror 24 for deflecting the stimulating ray 21A so that it scans the recording belt 1 across the width thereof (main scanning) is disposed in the optical path of the stimulating ray 21A. That is, as is clearly shown in FIG. 3, the stimulating ray 21A emitted from the stimulating ray source 21 is reflected by a mirror 22, and impinges upon the rotary polygonal mirror 24 after passing through an incident optical system 23 having a beam expander, a cylindrical lens and the like. Then the stimulating ray 21A is deflected by the polygonal mirror 24, travels through a scanning optical system 25 comprising an f$\theta$ lens and the like and through a cylindrical lens 26, and then impinges upon a part of the recording belt 1 on the lower peripheral surface of the roller 52 after being reflected by a cylindrical mirror **27*a*, and reflecting mirrors 27*b* and 27*c*. The cylindrical lens 26 and the cylindrical mirror 27*a* refract the stimulating ray 21A only in a plane parallel to the surface of the paper on which FIG. 1 is printed, and by virtue of these optical elements and the cylindrical lens in the incident optical system 23, fluctuations in the scanning line pitch can be prevented even if wobbling and/or surface deflection of the rotary polygonal mirror 24 occur. Between the reflecting mirror 27*c* and the recording belt 1 is disposed a beam splitter 28 which transmits the major part of the stimulating ray 21A and reflects the other part. The major part of the stimulating ray 21A impinges upon the stimulable phosphor layer on the recording belt 1 to cause it to emit light. On the other hand, the part (21*a*) of the stimulating ray reflected by the beam splitter 28 impinges upon a grid 29A which has alternately arranged light portions and dark portions and extends in the scanning direction, and light passing through the grid 29A is collected by a light collecting rod 29B located behind the grid 29A (FIG. 1). The light collected by the light collecting rod 29B is detected by a photodetector 29C and a synchronizing signal representing the scanning position of the stimulating ray 21A is thus obtained. The recording belt 1 is conveyed leftward as viewed in FIG. 1 at a constant speed while the stimulating ray 21A scans the recording belt 1 in the main scanning direction, thereby effecting sub-scanning, and thus the recording area which was exposed to radiation in the recording section 10 in order to store a radiation image of the object thereon is exposed to the stimulating ray 21A** substantially over the entire area thereof.

The parts of the recording belt exposed to the stimulating ray 21A emit light according to the radiation energy stored therein, and the emitted light is detected by a photoelectric read-out means 70. In this particular embodiment, the photoelectric read-out means 70 comprises a long photomultiplier 71 which extends beyond the ends of the main scanning line of the stimulating ray 21A on the recording belt 1 and has a light receiving face opposed to the scanning line on the recording belt 1, a filter 72 which is mounted on the light receiving face of the photomultiplier 71 and selectively transmits the light emitted by the stimulable phosphor layer upon stimulation and filters out the stimulating ray which impinges upon the photomultiplier after being reflected by the recording belt 1, and a light collecting plate 73 which is mounted on the filter 72 and serves to collect the light emitted by the stimulable phosphor layer with a high efficiency. Such a photoelectric read-out means is disclosed, for instance, in U.S. patent application Ser. No. 141,259. The light emitted by the part of the stimulable phosphor layer exposed to the stimulating ray 21A impinges upon the photomultiplier 71 through the light collecting plate 73 and the filter 72 and is converted into an electric image signal by the photomultiplier 71. The electric image signal thus obtained is subjected to some type of predetermined image processing and delivered to an image reproducing system which may take various forms. For example, the image reproducing system may be one which reproduces the radiation image on a CRT, or one which reproduces the radiation image on a photosensitive film by scanning the film with a light beam.

There has been known a radiation image read-out method in which a read out operation for ascertaining an outline of the image information of a radiation image stored in the stimulable phosphor layer on the recording belt (hereinafter referred to as the preliminary read out) is carried out in advance of the read-out operation for obtaining a visible image (referred to as the final read out). The final read out is then carried out according t read-out conditions determined in the preliminary read out.

For example, the preliminary read out can be carried out by scanning the stimulable phosphor layer with a stimulating ray having a lower stimulation energy than the stimulation energy of the stimulating ray used in the final read out, and then detecting the emitted light. See U.S. Pat. No. 4,527,060, for instance.

In the radiation image read-out section 20, both the preliminary read out and the final read out are carried out. That is, the preliminary read out is first carried out while the recording belt 1 is conveyed leftward, and then the rollers are reversed to return the recording belt 1 to the original position. Thereafter, the final read out is carried out while the recording belt 1 is conveyed leftward again. Generally, the recording belt 1 is conveyed at a higher speed during the preliminary read out than during the final read out.

After the read-out operation is completed, the recording area is fed to an erasing section 30 by the roller sections 40 and 50. The erasing section 30 comprises a housing 31 and a plurality of erasing light sources 32 accommodated in the housing 31. The erasing light sources 32 may be fluorescent lamps and are six in number in this particular embodiment. The erasing light sources 32 in the housing 31 mainly emit light within the wavelength rang which stimulates the stimulable phosphor on the recording belt 1. The residual radiation energy remaining in the stimulable phosphor layer after the image read-out operation is finished is released by exposing the whole image recording area to the erasing light while the recording belt 1 is conveyed. A lead plate 2 is disposed below the recording table 14 in order to prevent the radiation emitted from the radiation source 11 from interfering with the part of the recording belt 1 in the image read-out section 20, the erasing section 30 and the like. In the apparatus of this embodiment, the read-out operation and the erasing operation are carried out on a given recording area in parallel for a certain period. After the erasing operation, the recording area becomes available for another recording.

In the apparatus of this embodiment, a plurality of recordings are carried out with a high efficiency by moving the idle rollers 61 and 62 integrally with each other to the left or right. The recording of the radiation image in the image recording section 10 and read out of the radiation image in the image read-out section 20 are carried out either simultaneously or in sequence, but in both cases the movement of the grid 81 of the Potter-Bucky device 80 in the image recording section 10 transmits no vibration which can adversely affect the accuracy of the read out of the radiation image in the image read-out section 20. Now the relation between the position of the idle rollers 61 and 62 and the operation of each section of the apparatus will be described with reference to FIGS. 5(*a*) to 5(*g*) and FIGS. 6(*a*) to 6(*h*).

Figure 5E:
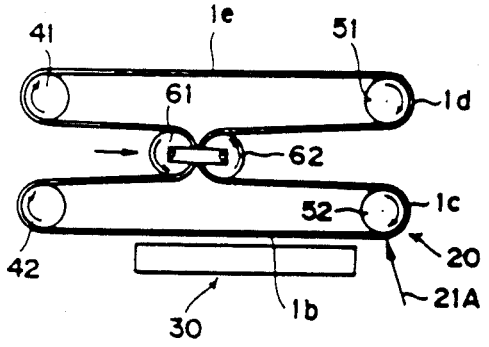
Figure 5F:
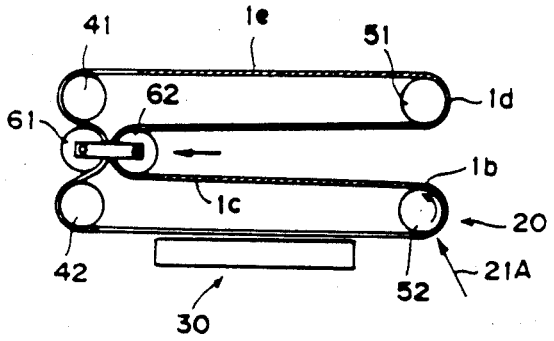
Figure 5G:
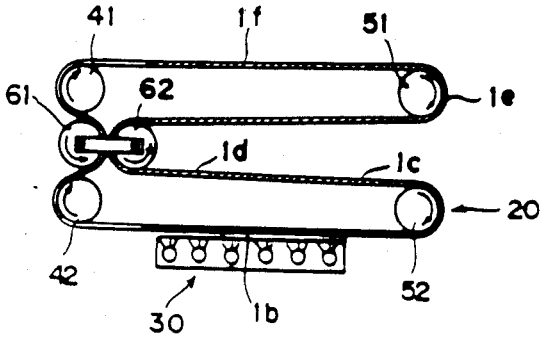
Figure 6A:
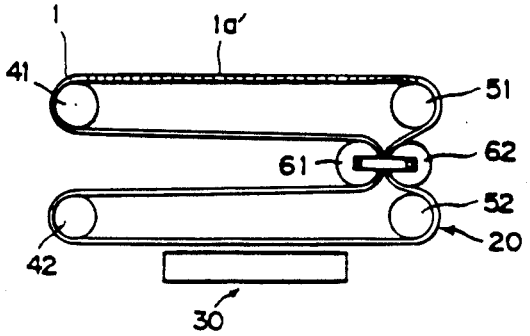
Figure 6B:
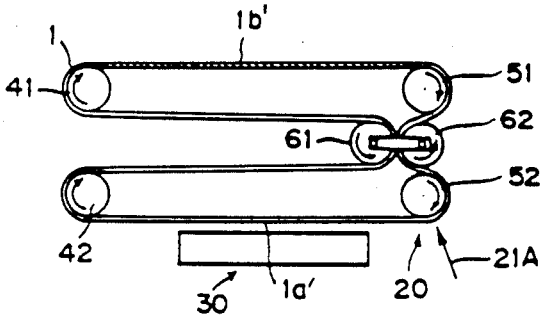
Figure 6C:
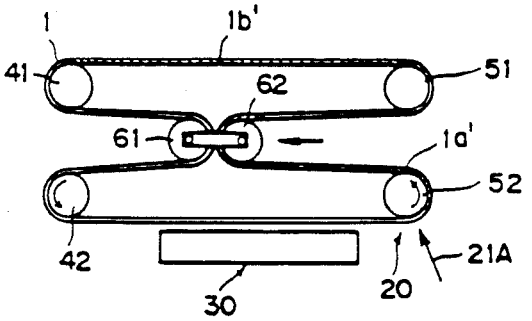
Figure 6D:
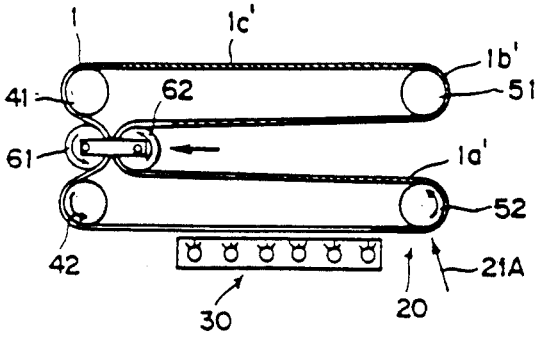
Figure 6E:
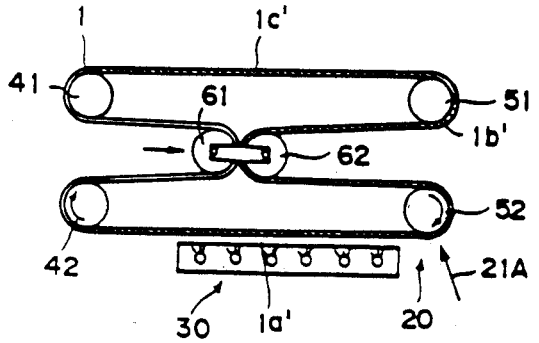
Figure 6F:
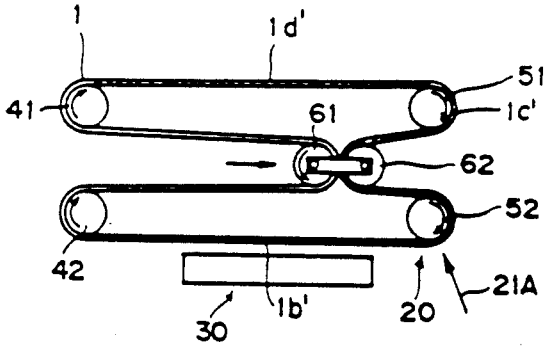
Figure 6G:
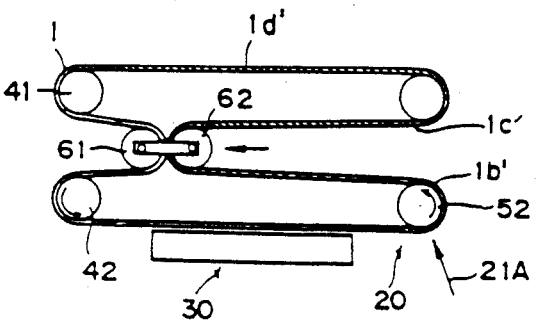
Figure 6H:
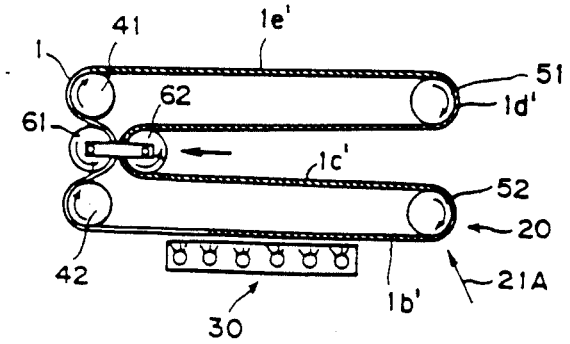

The recording of relatively small radiation images on the recording belt 1 is first described with reference to FIGS. 5(*a*) to 5(*g*). When the apparatus starts to operate, the idle rollers 61 and 62 are positioned at the right as shown in FIG. 5(*a*). The recording of a first image is carried out in this state. The first recording area, that is, the area which is exposed to radiation when recording the first image, is the hatched area 1*a*.

When the recording of the first image is completed, the first recording area 1*a* is conveyed to the image read-out section 20 by rotating the rollers, and the preliminary read out is carried out with the erasing light sources in the erasing section 30 off. When the preliminary read out of the first recording area 1*a* is completed, the recording of a second image is carried out on area lb of the recording belt 1, which area is positioned in the recording position upon completion of the preliminary read out of the first recording area 1*a*. Since the recording belt 1 is conveyed at a relatively high speed during the preliminary read out as described above, recording of the second image can be carried out in a relatively short time after completion of the recording of the first image. When the recording of the second image is completed, the idle rollers 61 and 62 are moved leftward as shown in FIG. 5(*c*). This returns the first recording area 1*a* to the read-out start position (the position in which the recording area is to be positioned when the read out is started) and at the same time brings a third recording area 1*c* to the recording position. Then the recording of a third image is carried out on the third recording area 1*c*.

Thereafter, the final read out is carried out on the first recording area in the image read-out section 20 while the rollers are rotated in the direction shown by the arrows in FIG. 5(*d*). At the same time, the idle rollers 61 and 62 are moved to the left as shown in FIG. 5(d) while the upper rollers 41 and 51 are rotated slightly faster than the other rollers, whereby a new recording area is brought to the recording position. Thus, a fourth recording area 1*d* adjacent to the third recording area 1*c* is brought to the recording position by rotation of the rollers and the movement of the idle rollers 61 and 62 at the time when the read out of the recording area la progresses to the position shown in FIG. 5(*d*). Thus the recording belt 1 is ready for the recording of a fourth image.

The recording belt 1 is ready for the recording of a fifth image when the final read out of the first recording area 1*a* is finished and the preliminary read-out of the second recording area 1*b* is finished. However, since there is a blank between the first and second recording areas 1*a* and 1*b* and the recording belt 1 is conveyed by a length larger than the length of one image frame by the time the preliminary read out of the second recording area 1*b* is finished, the idle rollers 61 and 62 are moved rightward as shown in FIG. 5(*e*) until the preliminary read out of the second recording area 1*b* is finished in order to allot an area adjacent to the fourth recording area 1*d* for a fifth recording area 1*e*. When the preliminary read out of the second recording area 1*b* is finished, the idle rollers 61 and 62 are moved to the left as shown in FIG. 5(f), whereby the second recording area 1*b* is returned to the read-out start position. At this time, the fifth recording area 1*e* is held in the recording position. Accordingly, the fifth recording can be carried out any time between the state shown in FIG. 5(*e*) and the state shown in FIG. 5(*f*).

The recording of a sixth image on a sixth recording area 1*f* adjacent to the fifth recording area 1*e* can be carried out after the final read out of the second recording area 1*b* is finished as shown in FIG. 5(*g*). The sixth recording area 1*f* is held in the recording position until the preliminary read out of the third recording area 1*c* is carried out (after the final read out of the second recording area 1*b*) and the third recording area 1*c* is subsequently returned to the readout start position. Accordingly the recording of the sixth image can be carried out any time in this period.

Now the relation between the position of the idle rollers 61 and 62 and the operation of each section of the apparatus for the recording of the largest-sized radiation images will be described with reference to FIGS. 6(*a*) to 6(*h*).

When the apparatus starts to operate, the idle rollers 61 and 62 are positioned to the right as shown in FIG. 6(*a*), and the recording of a first image is carried out on a first recording area 1*a*′ in this state, the first recording area 1*a*′ covering the whole upper run of the recording medium. When the recording of the first image is finished, the rollers are rotated in their respective positions to convey the recording belt 1 to a position in which the preliminary read out of the first recording area 1*a*′ is completed as shown in FIG. 6(*b*). When the recording belt 1 reaches this position, the recording of a second image can be carried out on the recording area 1*b*′ which is in the recording position at the time when the recording belt 1 reaches the position shown in FIG. 6(*b*). Then the idle rollers 61 and 62 are moved leftward to return the first recording area 1*a*′ to the read-out start position as shown in FIG. 6(*c*). The recording of a second image on the second recording area 1*b*′ may be carried out any time after the final read out of the first recording area 1*a*′ is started and before a third recording area is brought to the recording position. This minimizes the cycle time.

Thereafter, the final read out of the first recording area 1*a*′ is carried out in the image read-out section 20 while the recording belt 1 is conveyed at a constant speed by rotating the rollers in the direction shown in FIG. 6(*d*). At the same time, the idle rollers 61 and 62 are moved to the left while the upper rollers 41 and 51 are rotated faster than the other rollers, whereby a third recording area 1*c*′ adjacent to the second recording area 1*b*′ is fed toward the recording position. The third recording area 1*c*′ is wholly positioned in the recording position when the final read out of the first recording area 1*a*′ progresses to the position shown in FIG. 6(*d*). Thereafter, the idle rollers 61 and 62 are gradually moved rightward in response to the rotation of the lower roller 52 as shown in FIG. 6(*e*) until the final read out of the first recording area 1*a*′ is finished. Accordingly, it is preferred that the recording of a third image on the third recording area be carried out between the state shown in FIG. 6(*d*) and the state shown in FIG. 6(*e*).

The recording of a fourth image on an area 1*d*′ adjacent to the third recording area 1*c*′ can be carried out when the preliminary read out of the second recording area 1*b*′ is finished as shown in FIG. 6(*f*). At this time, the idle rollers 61 and 62 are moved slightly rightward in order to adjust the feed of the recording areas 1*d*′ and 1*b*′. Then the second recording area 1*b*′ is returned to the read-out start position by the leftward movement of the idle rollers 61 and 62 as shown in FIG. 6(*g*). Accordingly, it is preferred that the recording of a fourth image on the fourth recording area 1*d*′ be carried out between the state shown in FIG. 6(*f*) and the state shown in FIG. 6(*g*).

The final read out of the second recording area 1*b*′ is then carried out, and at the same time, the idle rollers 61 and 62 are moved to the left with the upper rollers 41 and 51 rotating faster than the other rollers, whereby an area 1*e*′ adjacent to the fourth area 1*d*′ is brought to the recording position, as shown in FIG. 6(*h*). As the final read out of the second recording area 1*b*′ progresses, the idle rollers 61 and 62 begin to move leftward again and the recording of a fifth image can be carried in this state.

As can be understood from the description above, the Potter-Bucky device having the balancer does not adversely affect the accuracy in the read out of the radiation image even if it is employed in a radiation image recording and read-out apparatus in which the image recording section 10, the image read-out section 20 and the erasing section 30 are disposed close to one another and the grid is reciprocated during, immediately before or immediately after the read-out operation in the image read-out section 20.

Figure 7:
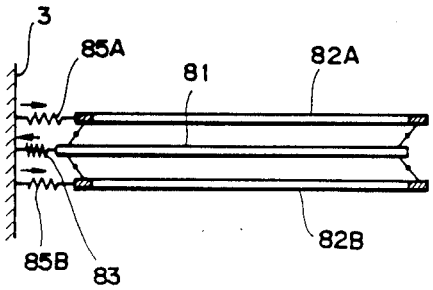
FIG. 7 is a side view showing a Potter-Bucky device in accordance with another embodiment of the present invention.

When vibrations which are generated by rotation of the whole Potter-Bucky device in cases where a single balancer is provided, as in the embodiment described above, cause practical problems, a pair of balancers 82A and 82B may be provided respectively on upper and lower sides of the grid 81 as shown in FIG. 7. When two balancers are provided, the grid may be disposed below, above or between the two balancers provided that the mass of the grid, the masses of the balancers, the length of the connecting member between the support and the grid and the length of the connecting member between the support and the balancer are selected so as not to cause displacement of the center of gravity of the whole Potter-Bucky device. For example, assuming that the connecting members are all equal to each other in length, the mass of the member (the grid or one of the balancers) disposed between the other members must be twice the mass of each of the other members.

Figure 8:
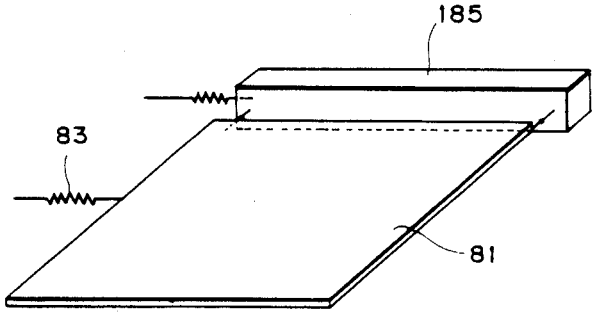
FIG. 8 is a perspective view showing a Potter-Bucky device in accordance with still another embodiment of the present invention.

Further, the position of the balancer need not be limited to the upper and lower sides of the grid, but the balancer may be provided on a side of the grid as shown in FIG. 8. In FIG. 8, the balancer is indicated at 185. Further, the means for reciprocating the grid need not be limited to that described in con]unction with the embodiment described above, but may be any means provided that it is suitable for compensating for the displacement of the center of gravity of the grid by use of the balancer. The Potter-Bucky device in accordance with the present invention may be provided in any radiation image recording apparatus without being limited to those having the radiation image read-out and recording sections in one unit. Further, the Potter-Bucky device in accordance with the present invention may also be provided in other radiation image recording systems such as those in which X-ray film is used as the recording medium.

I claim:

1. A Potter-Bucky device comprising:

grid means which is disposed in a radiation image recording apparatus for exposing an image recording medium to radiation which has passed through an object in order to record a radiationimage of the object on the recording medium and which is supported by a support means between the object and the recording medium;

grid driving means which reciprocates said grid means parallel to the recording medium;

balancer means which is connected to the support means and reciprocated in synchronization with said grid but in the opposite direction, said balancer means for compensating for displacement of the center of gravity of the Potter-Bucky device due to the reciprocation of the grid.

2. A Potter-Bucky device as claimed in claim 1, wherein a mass of said grid means is equal to a mass of said balancer means.

3. A Potter-Bucky device as claimed in claim 2, wherein an inertia of said grid means is equal to an inertia of said balancer means during reciprocation.

4. A Potter-Bucky device as claimed in claim 3, wherein said grid driving means comprises:

displacement means for selectively displacing said grid means from a normal position thereof; and spring means attached to at least one of said grid means and balancer means, for being deformed when said grid means is displaced from said normal position thereof and for causing reciprocation of said grid means.

5. A Potter-Bucky device as claimed in claim 4, wherein said balancer means is disposed with respect to one of: a side of said grid means which faces a source of radiation; a side of said grid which faces away from a source of radiation; and an edge side of said grid means and in a plane defined by a major surface of said grid means.

6. A Potter-Bucky device as claimed in claim 4, wherein said balancer means comprises first and second balancing means which are disposed with respect to a side of said grid means which faces a source of radiation and an opposing side of said grid which faces away from a source of radiation, respectively.

7. A Potter-Bucky device comprising:

grid means which is disposed in a radiation image recording apparatus for exposing an image recording medium to radiation which has passed through an object in order to record a radiation image of the object on the recording medium and which is supported by a support means between the object and the recording medium;

grid driving means which reciprocates said grid means parallel to the recording medium;

balancer means exclusive of said grid means and which is connected to the support means and reciprocated in synchronization with said grid but in the opposite direction, said balancer means for compensating for displacement of the center of gravity of the Potter-Bucky device due to the reciprocation of the grid.

8. A Potter-Bucky device as claimed in claim 7, wherein a mass of said grid means is equal to a mass of said balancer means.

9. A Potter-Bucky device as claimed in claim 8, wherein an inertia of said grid means is equal to an inertia of said balancer means during reciprocation.

10. A Potter-Bucky device as claimed in claim 9, wherein said grid driving means comprises:

displacement means for selectively displacing said grid means from a normal position thereof; and spring means attached to at least one of said grid means and balancer means, for being deformed when said grid means is displaced from said normal position thereof and for causing reciprocation of said grid means.

11. A Potter-Bucky device as claimed in claim 10, wherein said balancer means is disposed with respect to one of: a side of said grid means which faces a source of radiation; a side of said grid which faces away from a source of radiation; and an edge side of said grid means and in a plane defined by a major surface of said grid means.

12. A Potter-Bucky device as claimed in claim 10, wherein said balancer means comprises first and second balancing means which are disposed with respect to a side of said grid means which faces a source of radiation and an opposing side of said grid which faces away from a source of radiation, respectively.

* * * * *